US005934032A

United States Patent [19]

Oberdörfer

[11] Patent Number: 5,934,032

[45] Date of Patent: Aug. 10, 1999

[54] FLUSH-TYPE MOUNTING BOX FOR SANITARY FITTINGS

[75] Inventor: Hans Oberdörfer, Stuttgart, Germany

[73] Assignee: Hansa Metallwerke AG, Germany

[21] Appl. No.: 08/966,080

[22] Filed: Nov. 7, 1997

[30] Foreign Application Priority Data

Nov. 23, 1996 [DE] Germany ..... 196 48 587

[51] Int. Cl.[6] ..... E03C 1/04

[52] U.S. Cl. ..... 52/220.8; 52/35; 52/220.1

[58] Field of Search ..... 52/35, 220.1, 220.8

[56] References Cited

U.S. PATENT DOCUMENTS

| | | | |
|---|---|---|---|
| 5,201,433 | 4/1993 | Thul | 52/220.8 X |
| 5,287,665 | 2/1994 | Rath, Jr. | 52/220.8 |

FOREIGN PATENT DOCUMENTS

| | | |
|---|---|---|
| 81 10 406 U | 7/1982 | Germany . |
| 32 37 418 | 4/1984 | Germany . |
| 32 37 419 | 4/1984 | Germany . |
| 87 08 817 U | 10/1987 | Germany . |
| 37 37 767 | 5/1989 | Germany . |
| 42 17 529 | 12/1993 | Germany . |
| 4217529 | 12/1993 | Germany . |

*Primary Examiner*—Christopher Kent

[57] ABSTRACT

A flush type mounting box for sanitary fittings carries on the outer surface of its side walls an annular collar of resilient material. This collar includes as one piece, a sealing region that is displaceable on the outer surface of the side walls, and a flange region, which is arranged to be introduced into the gap between two facing elements of the mounting wall and is fixed there, forming a seal. By this collar, the gap between the access opening in the facing elements and the mounting box can be sealed against moisture penetration. In the case of lining wall systems, corresponding to the distance between the supporting mounting plate of the mounting wall and the facing elements, the sealing region of the collar bears at different points on the outer surface of the side walls of the mounting box.

5 Claims, 3 Drawing Sheets

FLUSH-TYPE MOUNTING BOX FOR SANITARY FITTINGS

BACKGROUND OF THE INVENTION

Technical Field

The invention relates to a flush-type mounting box for sanitary fittings, especially for use with lining wall systems in the dry installation of sanitary appliances, having a) a base running in the fitted state approximately parallel to the surface of the mounting wall;

b) side walls running in the fitted state approximately perpendicular to the surface of the mounting wall, which side walls together with the base define an inner cavity open on one side;

c) at least one lead-through for a water supply pipe;

d) fixing means for a sanitary fitting to be mounted in the inner cavity.

BACKGROUND INFORMATION

Flush-type mounting boxes serve to keep open and define the installation space for a concealed sanitary fitting inside a mounting wall. The mounting wall has in this case an access opening which allows access to the mounting box and in the finished state is covered over by removable trim elements (e.g. a round plate). Between the edges of the access opening in the mounting wall and the side walls of the mounting box there generally remains a certain gap, through which moisture is able to penetrate into the interior of the wall. Sealing of this gap presents problems for dry installations, especially in the case of so-called lining wall systems. The thickness of such lining walls, which is generally defined by the distance between a mounting plate, which constitutes the supporting structure, and a lining facing towards the interior of the room, varies considerably depending on the installation site and manufacturer of the lining wall system. To the Applicant's knowledge, this sealing problem has still not been successfully resolved.

DE-C-32 37 419 describes a wall installation of a concealed sanitary fitting. This known wall installation does not make use of a mounting box, however; on the contrary, the fitting housing of the corresponding sanitary fitting is located directly inside the mounting wall. A moisture-proof foil extends in the region of the lining of the mounting wall substantially over the entire extent thereof. To bridge the gap between the outer surface of the fitting housing and the moisture-proof foil a rigid flange is provided, to which the suitably cut-out edge of the damp-proof foil can be clamped. In the exemplary embodiment illustrated in FIG. 2 of DE-C-32 37 419, the flange is arranged to slide axially on the outer surface of the fitting housing.

SUMMARY OF THE INVENTION

The present invention is based on the problem of designing a mounting box of the kind mentioned in the introduction, such that with different thicknesses of the mounting wall or with different installation depths of the mounting box in the wall, it is possible to seal the gap between the access opening in the mounting wall and the side walls of the mounting box in a reliable manner.

That problem is solved in accordance with the invention in that on the outer surface of the side walls of the mounting box there is arranged an annular collar of resilient material, which comprises:

e) a sealing region lying displaceably on the side walls;

f) a flange region formed integrally with the sealing region, which flange region extends in the fitted state approximately parallel to the outer surface of the wall and is arranged to be fixed, forming a seal, to a component of the wall, especially a facing, facing towards the interior of the room.

In accordance with the invention the gap between the access opening in the installation wall and the mounting box is therefore tightly sealed by a resilient collar, which lies with a sealing region displaceably on the outer surface of the mounting box. The mounting position of this sealing region on the mounting box depends on the installation depth of the mounting box and therefore generally on the thickness of the mounting wall. The onepiece flange region of the resilient collar extends parallel to the mounting wall and is fixed to this or to the lining thereof. It extends only as far as is required to achieve a good anchoring and a good seal. A moisture-proof membrane extending over the entire wall area is not provided in this case. By virtue of the resilience of the material used for the collar and by virtue of the fact that the sealing region is displaceable on the outer surface of the mounting box, an extremely flexible adaptation to widely varying installation circumstances is possible.

A practical form of the invention in which the sealing region comprises two sealing lips arranged spaced apart from one another is preferred. The resulting double sealing line prevents the ingress of moisture into the interior of the mounting wall even better than when using a single sealing line. In addition, the displaceable sealing region is thus guided more easily on the outer surface of the mounting box.

An especially preferred construction of the invention is distinguished in that the sealing region is surrounded by a rigid supporting ring. This rigid supporting ring ensures the necessary degree of compression of the sealing region against the outer surface of the mounting box, which guarantees a good seal.

In respect of production technology, it is especially favourable for the sealing region to engage with an interlocking fit in the supporting ring.

The facing of the mounting wall facing towards the interior of the room often consists of two components. Thus, for example, in lining wall systems, a gypsum plasterboard is generally used as facing, which is then tiled. In such a case the flange region of the collar according to the invention can be introduced between the two elements of the facing and be secured there by adhesion. If the flange region is then provided in its outer region with a plurality of holes, the adhesive passes through these holes. This improves the anchoring of the flange region of the collar inside the wall facing.

BRIEF DESCRIPTION OF THE DRAWINGS

An exemplary embodiment of the invention is explained in further detail hereinafter with reference to the drawings, in which.

DESCRIPTION OF THE PREFERRED EMBODIMENT

Figure 1:
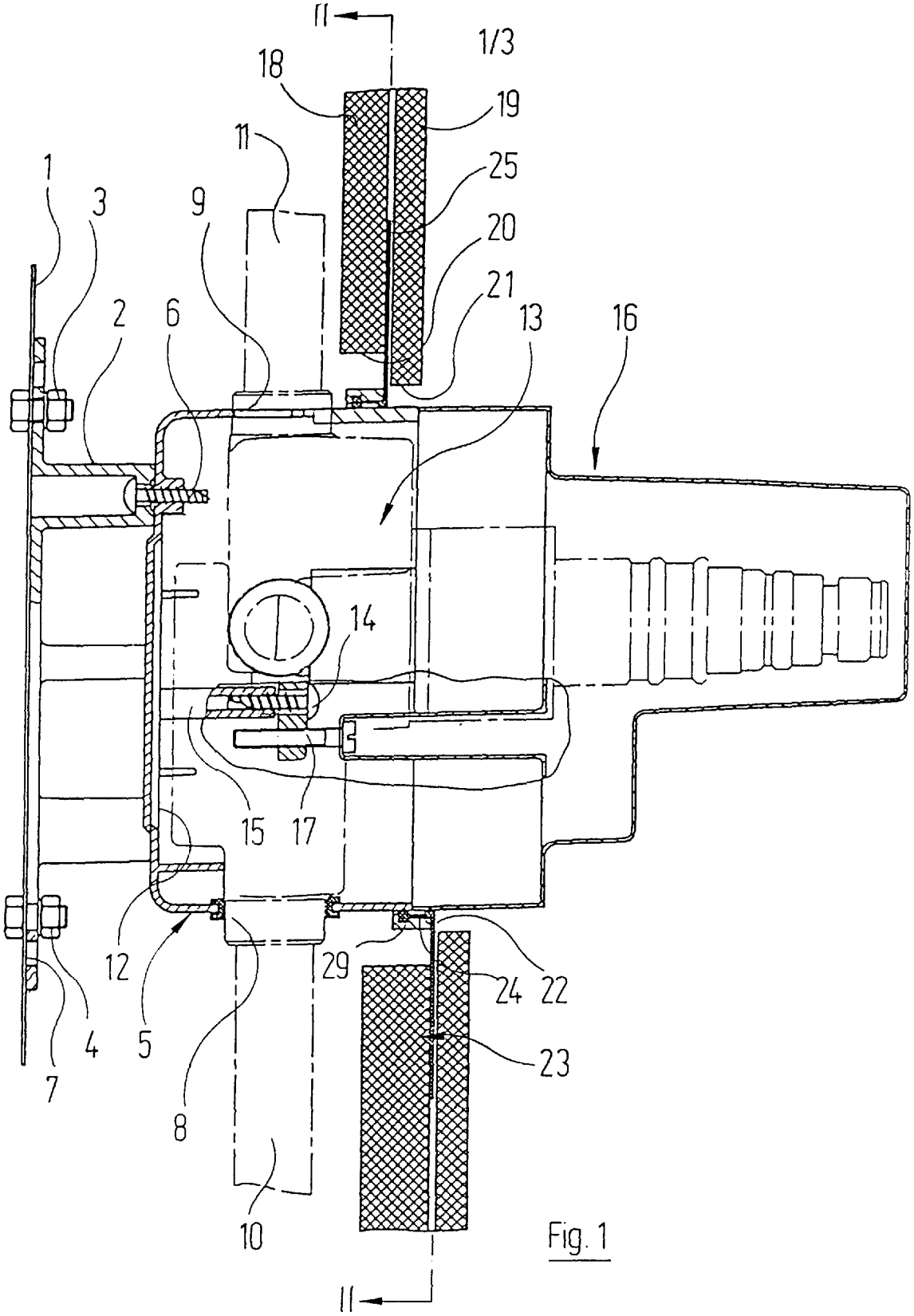
FIG. 1 shows a vertical section through a mounting box set in a lining wall, different installation depths being illustrated in the upper and lower halves of the Figure.

In FIG. 1, the reference numeral 1 indicates the mounting plate of a lining wall system for the dry installation of sanitary appliances, which plate is provided with a plurality of holes for fixing a wide variety of building components. A spacer element 2 is fixed at selected holes of this mounting plate 1 by screw connections 3, 4; a mounting box 5 is secured to the spacer element in turn by means of screws 6. The spacer element 2 serves not only to space the mounting box 5 by the correct distance from the mounting plate 1; it serves at the same time as an "adapter", which by means of sets of bores 7 is able to effect connection to different hole systems in the mounting plates 1 of different manufacturers.

Water supply pipes 10 and water outlet pipes 11, indicated by dot-dash lines, are introduced via lead-throughs 8, 9 in the side walls of the mounting box 5 into the interior 12 of the mounting box 5 and are there connected to a sanitary fitting 13, also illustrated by a dot-dash line. The sanitary fitting 13 in its turn is fixed by means of screws 14 to a fixing projection 15 of the mounting box 5.

The sanitary fitting 13 projects outwards beyond the mounting box 5 and is protected there whilst the construction is in an unfinished state in known manner by a cover 16, which is placed at the front onto the open end of the mounting box 5 and in the exemplary embodiment illustrated is releasably mounted on the sanitary fitting 13 by means of a screw 17. On finishing the shell of the construction, or on completion of the lining wall on which the mounting box 5 with the sanitary fitting 13 is provided, the cover 16 is removed in known manner and then replaced and supplemented by suitable trim elements, especially a round cover plate and a masking cover and, if desired, by the operating element of the sanitary fitting.

In FIG. 1, the reference numeral 18 denotes a gypsum plasterboard, as is commonly used in the building of lining walls of the kind of interest here as a facing element facing towards the interior of the room. Over this gypsum plasterboard 18 a tiling 19 is mounted as a further element of the facing. Both the gypsum plasterboard 18 and the tiling 19 have an access opening 20 respectively 21, which provides access to the mounting box 5.

Between the access openings 20, 21 and the mounting box 5 there remains a gap 22, which in the region of the access opening 20 in the gypsum plasterboard 18 is normally wider than in the region of the access opening 21 of the tiling 19. To prevent moisture from penetrating through this gap 22 into the interior of the lining wall, that is, behind the tiling 19 and gypsum plasterboard 18, an annular resilient collar 23 is provided, which closes this gap. The collar 23 comprises, as one piece, a sealing region 24, which lies displaceably on the outer surface of the mounting box 5, and a flange region 25, which extends right into the gap between the tiling 19 and the gypsum plasterboard 18 and is secured there by adhesion.

Figure 3:
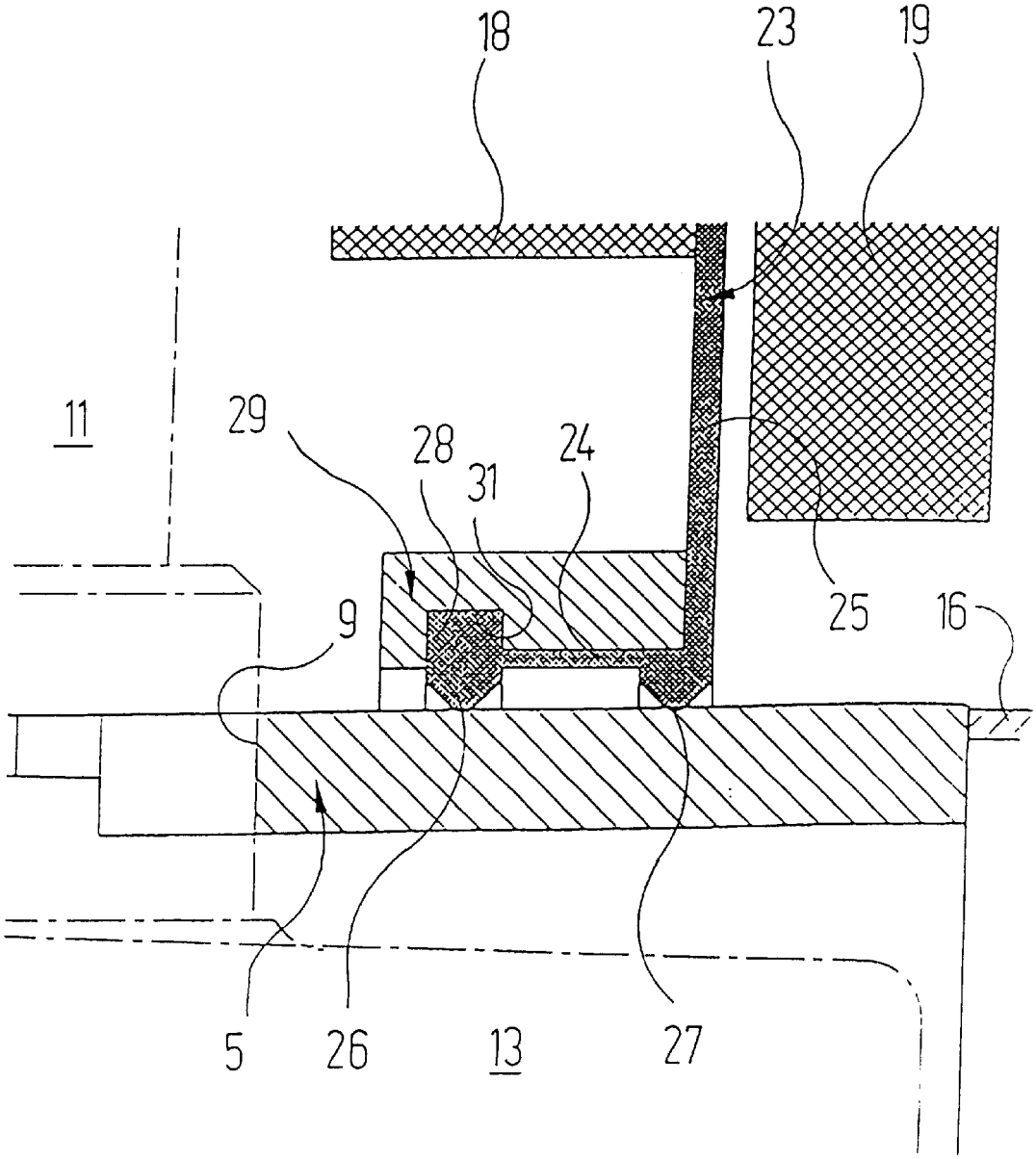
FIG. 3 is an enlarged view of a fragment from FIG. 1.

The sealing region 24 of the collar 23 is shown in more detail in FIG. 3. As that Figure shows, the collar comprises two radially inwardly projecting integrally moulded sealing lips 26, 27 and a radially outwardly projecting rib 28. The sealing region 24 of the collar 23 is connected to a supporting ring 29 of rigid material such that the rib 28 engages with an interlocking fit in a channel 31 of the supporting ring 29. The supporting ring 29 presses the sealing lips 26, 27 of the sealing region 24 with the required degree of compression against the outer surface of the mounting box 5.

The annular shapes of the sealing region 24 of the collar 23 and of the supporting ring 26 are matched to the outside contour of the mounting box 5; if this outside contour is circular, then the sealing region 24 and the supporting ring 29 are correspondingly shaped circular rings. If, on the other hand, the outside contour of the mounting box 5 is rectangular in cross-section, then correspondingly the sealing region 24 and the supporting ring 29 are "rectangular rings".

Figure 2:
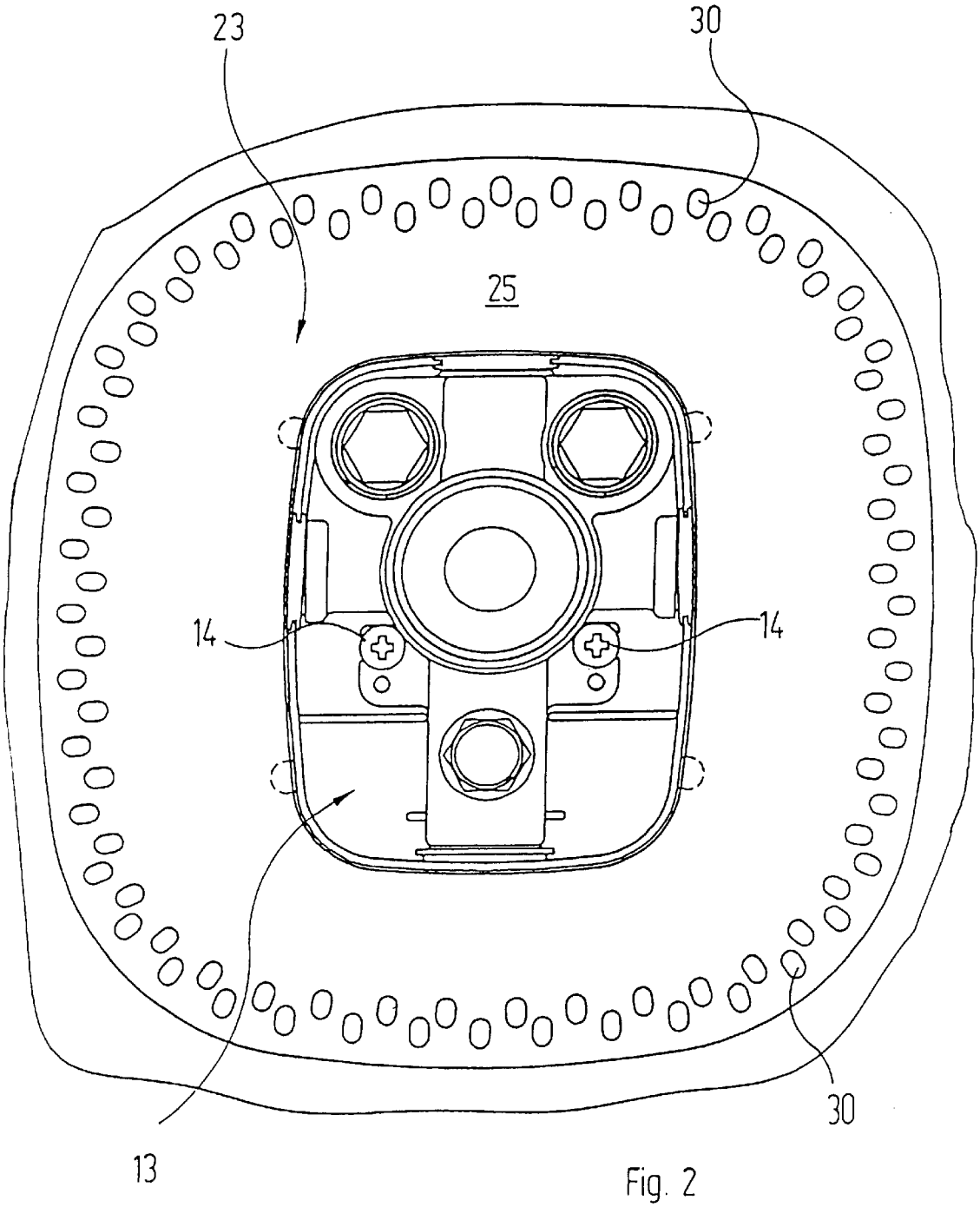
FIG. 2 shows a section along the line II—II of FIG. 1.

The flange region 25 of the collar 23 is illustrated in the plan view in FIG. 2. As is apparent, this flange region 25 is provided close to its outer edges with a plurality of holes 30. Adhesive passes through these holes as the tiling 19 and the gypsum plasterboard are being adhesively bonded, so that the circumferential edge of the flange region 25 is firmly anchored between tiling 19 and gypsum plasterboard 18. The form of the outside contour of the flange region 25 of the collar 23 follows substantially the form of the access openings 20 and 21 that have been made in the gypsum plasterboard 18 and the tiling 19 respectively, and thus follows generally the form of the mounting box 5. The width of the flange region 25 is selected so that reliable anchoring between the gypsum plasterboard 18 and tiling 19 and a good seal are ensured.

As already mentioned, the sealing region 24 of the collar 23 is displaceable on the outside contour of the mounting box 5. In this way, allowances can be made for different distances between the mounting plate 1 and the visible facing formed by the gypsum plasterboard 18 and tiling 19. The upper half of FIG. 1 illustrates a case in which this distance is comparatively small. The sealing region 24 of the collar 23 then lies comparatively "far in", that is, lies comparatively close to the mounting plate 1 on the outside contour of the mounting box 5 to form a seal. It is different in the lower half of FIG. 1, showing in a case in which the distance between the facing comprising gypsum plasterboard 18 and tiling 19 and the mounting plate 1 is comparatively large. Here, the sealing region 24 of the collar 23 has been slid right to the outermost edge of the mounting box 5, so that only one (26) of the two sealing lips 26, 27 is lying on the outside contour of the mounting box 5 itself, whereas the second (27) of these sealing lips is lying on the cover 16.

This construction shows that, with different makes of lining wall systems, a good damp barrier can be achieved in the space between the facing directed towards the interior of the room and the mounting plate of the lining wall.

What is claimed is:

1. Flush-type mounting box for sanitary fittings, especially for use with lining wall systems in the dry installation of sanitary appliances, having a) a base arranged in a fitted state of the mounting box to run approximately parallel to a surface of a mounting wall;

b) side walls arranged in a fitted state of the mounting box to run perpendicular to the surface of a mounting wall, said side walls together with said base defining an inner cavity open on one side;

c) at least one lead-through on said box for a water supply pipe;

d) fixing means for a sanitary fitting to be mounted in the inner cavity;

on an outer surface on the side walls there is arranged an annular collar of resilient material, which comprises:

e) a sealing region that is displaceable on the side walls;

f) a flange region formed integrally with the sealing region, which flange region extends in a fitted state of the mounting box approximately parallel to an outer surface of the mounting wall and is arranged to be fixed, forming a seal, to a component of the mounting wall facing towards the interior of the room.

2. Mounting box according to claim 1, the sealing region of which comprises two annular sealing lips arranged spaced apart from one another.

3. Mounting box according to claim 1, the sealing region of which is surrounded by a rigid supporting ring.

4. Mounting box according to claim 3, the sealing region of which engages with an interlocking fit in the supporting ring.

5. Mounting box according to claim 1, the flange region of which is provided in an outer region of the flange region with a plurality of holes.

* * * * *